US009421546B2

(12) United States Patent
Robert et al.

(10) Patent No.: US 9,421,546 B2
(45) Date of Patent: Aug. 23, 2016

(54) UNIVERSAL SHELVING SYSTEM

(75) Inventors: Maxime Robert, L'Ancienne-Lorette (CA); Claude Gravel, Quebec (CA); Luca Serli, Quebec (CA)

(73) Assignee: STERIS Inc., Temecula, CA (US)

( * ) Notice: Subject to any disclaimer, the term of this patent is extended or adjusted under 35 U.S.C. 154(b) by 878 days.

(21) Appl. No.: 13/461,148

(22) Filed: May 1, 2012

(65) Prior Publication Data

US 2012/0279535 A1 Nov. 8, 2012

Related U.S. Application Data

(60) Provisional application No. 61/481,984, filed on May 3, 2011.

(51) Int. Cl.
*A47L 15/50* (2006.01)
*B01L 99/00* (2010.01)

(52) U.S. Cl.
CPC ..... *B01L 99/00* (2013.01)

(58) Field of Classification Search
CPC ..... A61L 2/26; A61L 2/18; A47L 15/507; B01L 99/00; B60T 11/20
USPC ..... 134/199, 201, 137, 165, 166 R, 170, 134/191, 198, 200; 312/228.1, 311, 349, 312/408, 410
See application file for complete search history.

(56) References Cited

U.S. PATENT DOCUMENTS 3,590,863 A * 7/1971 Faust ..... B01L 99/00 134/144
5,904,162 A * 5/1999 Ferguson ..... A47L 15/4268 134/133
6,571,812 B1 * 6/2003 Lavoie ..... A61L 2/18 134/191
2005/0265877 A1 * 12/2005 Robert ..... A61M 39/10 417/572

* cited by examiner

*Primary Examiner* — David Cormier
*Assistant Examiner* — Thomas Bucci
(74) *Attorney, Agent, or Firm* — Kusner & Jaffe; Michael A. Centanni

(57) ABSTRACT

A washer, comprising a washing chamber defined by a pair of side walls, a top wall and a bottom wall, the washing chamber having an opened front face and an opened back face. A first shelf assembly is mounted within the washing chamber having at least one shelf section for receiving and supporting articles to be cleaned during a washing operation. A second shelf assembly is mounted within the washing chamber vertically above the first shelf. The second shelf assembly is mounted to the side walls having at least two shelf sections, at least one of the at least two shelf sections being selectively removable from the washing chamber so that additional space may be provided for larger articles on one side of the first shelf, and so that articles may be inserted into or removed from the washing chamber through the front face or back face of the washing chamber.

19 Claims, 10 Drawing Sheets

UNIVERSAL SHELVING SYSTEM

This application is a Continuation of Provisional application No. 61/481,984, filed on May 3, 2011.

FIELD OF THE INVENTION

The present invention relates generally to the art of cleaning and decontamination, and more particularly, to an apparatus for cleaning, washing, sterilizing and disinfecting laboratory glassware.

BACKGROUND OF THE INVENTION

Glassware, such as volumetric flasks, beakers, test tubes and the like are commonly used in laboratories. After each use in a laboratory test or procedure, the glassware must be thoroughly cleaned to remove deposits which could contaminate materials that are subsequently contained in the glassware. Glassware is often cleaned manually with a brush. However, this manual procedure is generally undesirable because it requires considerable time and effort.

To minimize manual cleaning time, laboratory glassware washing machines have been developed. Known laboratory glassware washing machines operate analogous to household dishwashers wherein the glassware is placed on racks within the washing machine. More specifically, the glassware is inverted such that the mouth and the neck of the glassware is received on a spindle extending vertically from the rack. Typically, the racks are movable on shelves into and out of the washing chamber of the glassware washing machine. At least one spray arm is typically located beneath the rack to apply upwardly directed wash and rinse sprays for washing and rinsing the glassware. Such glassware washing machines typically include a drying cycle for drying the glassware with heated air circulated within the washing chamber of the glassware washing machine. Although this type of glassware washing machine effectively cleans and dries a variety of different types of glassware articles, it has some drawbacks. As will be appreciated, the glassware to be washed, namely, flasks, beakers, test tubes and the like, come in many different sizes and shapes. For example, test tubes are generally smaller in width and height as compared to beakers or flasks. In addition, graduated cylinders are manufactured to have a wide range of heights and diameters, and flasks and beakers typically have enlarged bottom portions requiring more room when being washed.

To maximize the number and type of glassware articles that can be washed at the same time during a washing cycle, it is known to provide washers having removable and replaceable shelf and rack systems. Washers with removable racks or shelves allow an operator to choose a rack designed to receive a particular size of glassware, or to remove shelves to allow taller, elongated glassware to be positioned on lower racks within the washing chamber of the washing machine.

For example, U.S. Pat. No. 6,571,812 to Lavoie et al. discloses a universal shelving system having a permanent lower shelf for supporting a plurality of removable racks and an upper shelf comprised of three (3) shelf sections, each of which can be removed from the washing chamber to allow the racks on the lower shelf to hold taller, larger glassware that would not normally fit within the space between the upper and lower shelves. The washing chamber disclosed in the aforementioned patent includes a generally U-shaped fluid conduit that extends along the back wall and side walls of the washing chamber to provide washing and rinsing fluids to the racks and articles to be washed on the upper shelf. The U-shaped fluid conduit is disposed at approximately the mid-level in the washing chamber, and includes openings that allow for attachment of the aforementioned shelf sections, that form the upper shelf, to the channel. The shelf sections, when attached to the U-shaped conduit, are in fluid communication with the washing and/or rinsing fluid that is circulated through the U-shaped fluid conduit by the washer. The fluid is then conveyed through the shelf sections into the racks wherein the washing or rinsing fluid is directed into to the spindles and to nozzles in the spindle that direct the fluid to the interior of the glassware.

The shelving system disclosed in U.S. Pat. No. 6,571,812 allows individual shelf sections to be removed from the upper shelf to facilitate taller and larger glassware to be placed on the lower rack and shelves. When a shelf section is removed from the upper shelf, flaps associated with the opening in the fluid conduit would generally close off the opening such that washing or rinsing fluid would not flow through the opening during a washing or rinsing cycle.

While the shelving system disclosed in U.S. Pat. No. 6,571,812 was an improvement over the then-existing prior art, the configuration and position of the U-shaped fluid conduit generally limited insertion and removal of racks into the washer to one side, i.e., the front face, of the washing apparatus. Still further, each shelf section was mountable within the washing chamber in only one, specific location. Still further, the U-shaped fluid conduit had a rectangular cross-section that created problems in draining fluid from the system after the washing and rinsing cycles.

The present invention provides an improved shelving system of the type heretofore described and provides a fluid distribution line disposed outside the washing chamber and shelf sections that are mountable on the side walls of the washing chamber such that racks that are supported on the shelf sections may be inserted and removed through the front face and back face of the washing apparatus. Still further, a shelving system according to the present invention provides a mounting structure wherein each of the shelf sections can be mounted to each of the side walls of the washing chamber. In addition, the shelving system includes fluid connections that allow for more accurate sealing between a fluid distribution line and the shelf sections, and between the shelf sections and racks supported thereon to provide a more fluid tight connection therebetween.

SUMMARY OF THE INVENTION

In accordance with a preferred embodiment of the present invention, there is provided a washer, comprising a washing chamber defined by a pair of side walls, a top wall and a bottom wall, the washing chamber having an opened front face and an opened back face. A first shelf assembly is mounted within the washing chamber having at least one shelf section for receiving and supporting articles to be cleaned during a washing operation. A second shelf assembly is mounted within the washing chamber vertically above the first shelf. The second shelf assembly is mounted to the side walls having at least two shelf sections, at least one of the at least two shelf sections being selectively removable from the washing chamber so that additional space may be provided for larger articles on one side of the first shelf, and so that articles may be inserted into or removed from the washing chamber through the front face or back face of the washing chamber.

An advantage of the present invention is a decontamination unit (washer) for washing laboratory glassware having a washing chamber and a plurality of shelves for receiving and supporting glassware articles to be cleaned.

Another advantage of the present invention is a decontamination unit (washer) as described above having an upper shelf and a lower shelf, wherein the upper shelf has at least two (2) shelf sections and at least one of the two shelf sections is removable from the decontamination unit (washer).

Another advantage of the present invention is a decontamination unit (washer) as described above wherein each of the shelves supports a plurality of rack assemblies that are each slidable into and out of the washing chamber.

A still further advantage of the present invention is a decontamination unit (washer) as described above wherein the rack assemblies are removable from the decontamination unit (washer).

Another advantage of the present invention is a decontamination unit (washer) as described above that allows for rack assemblies to be inserted through one side of the decontamination unit (washer) and removed through another side of the decontamination unit (washer).

A still further advantage of the present invention is a decontamination unit (washer) as described above having fluid connections that extend through opposing sides of the decontamination unit (washer), which fluid connections are attachable to the shelves and shelf sections.

Another advantage of the present invention is a decontamination unit (washer) as described above wherein the shelves, shelf sections and rack assemblies are fluidly connected to each other to allow washing and rinsing fluids to flow from the decontamination unit (washer) to the shelf system, and through the shelf system to spindles on the rack assemblies, when the rack assemblies and shelves are in position within the washing chamber.

A still further advantage of the present invention is a decontamination unit (washer) as described above wherein a fluid-tight connection is made between the side walls of the decontamination unit (washer) and the removable shelf sections, and between the removable shelf sections and the rack assemblies thereon when the rack assemblies are in proper alignment with the shelves within the washing chamber during a decontamination cycle.

A still further advantage of the present invention is a decontamination unit (washer) as described above wherein movable valve elements connect the decontamination unit (washer) to the shelves and shelf sections, and the shelf sections and shelves to the rack assemblies.

A still further advantage of the present invention is a decontamination unit (washer) as described above having a more fluid-tight seal between the decontamination unit (washer), shelves, shelf sections and rack assemblies that allows a pump that is part of the fluid distribution section of the decontamination unit (washer) to operate at lower speeds.

Another advantage of the present invention is a decontamination unit (washer) as described above which is less likely to leak when fluid is circulated from the decontamination unit (washer) circulation system to the shelves, the shelf sections and the rack assemblies.

A still further advantage of the present invention is a decontamination unit (washer) as described above that utilizes round tubing to reduce retention of water in the circulation system when the circulation system is drained after a washing or rinsing cycle.

Another advantage of the present invention is a decontamination unit (washer) as described above which is less likely to retain fluid in lines between operating cycles and is thus able to improve rinsing of the articles within the decontamination unit (washer).

A still further advantage of the present invention is a decontamination unit (washer) as described above that allows better draining of fluid lines between operating cycles by reducing fluid retained in the fluid lines.

A still further advantage of the present invention is a decontamination unit (washer) as described above wherein shelving sections can easily and quickly be removed from the washing chamber to accommodate larger glassware within the washing chamber.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
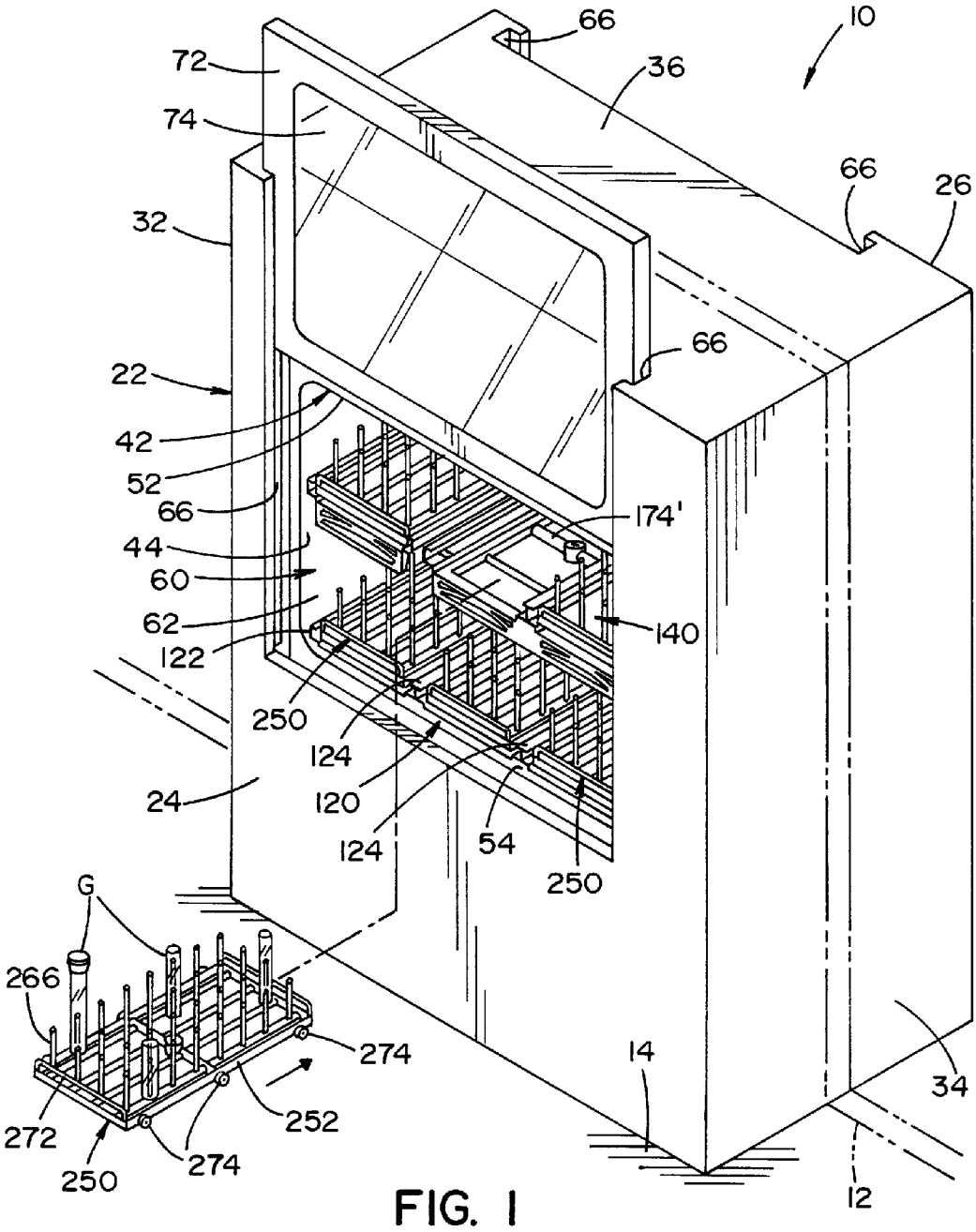
FIG. 1 is a front, perspective view of a decontamination unit (washer) showing a front door disposed in the front side of the decontamination unit (washer) in an opened position to show an interior washing chamber, and a rack assembly removed from the washing chamber.
Figure 2:
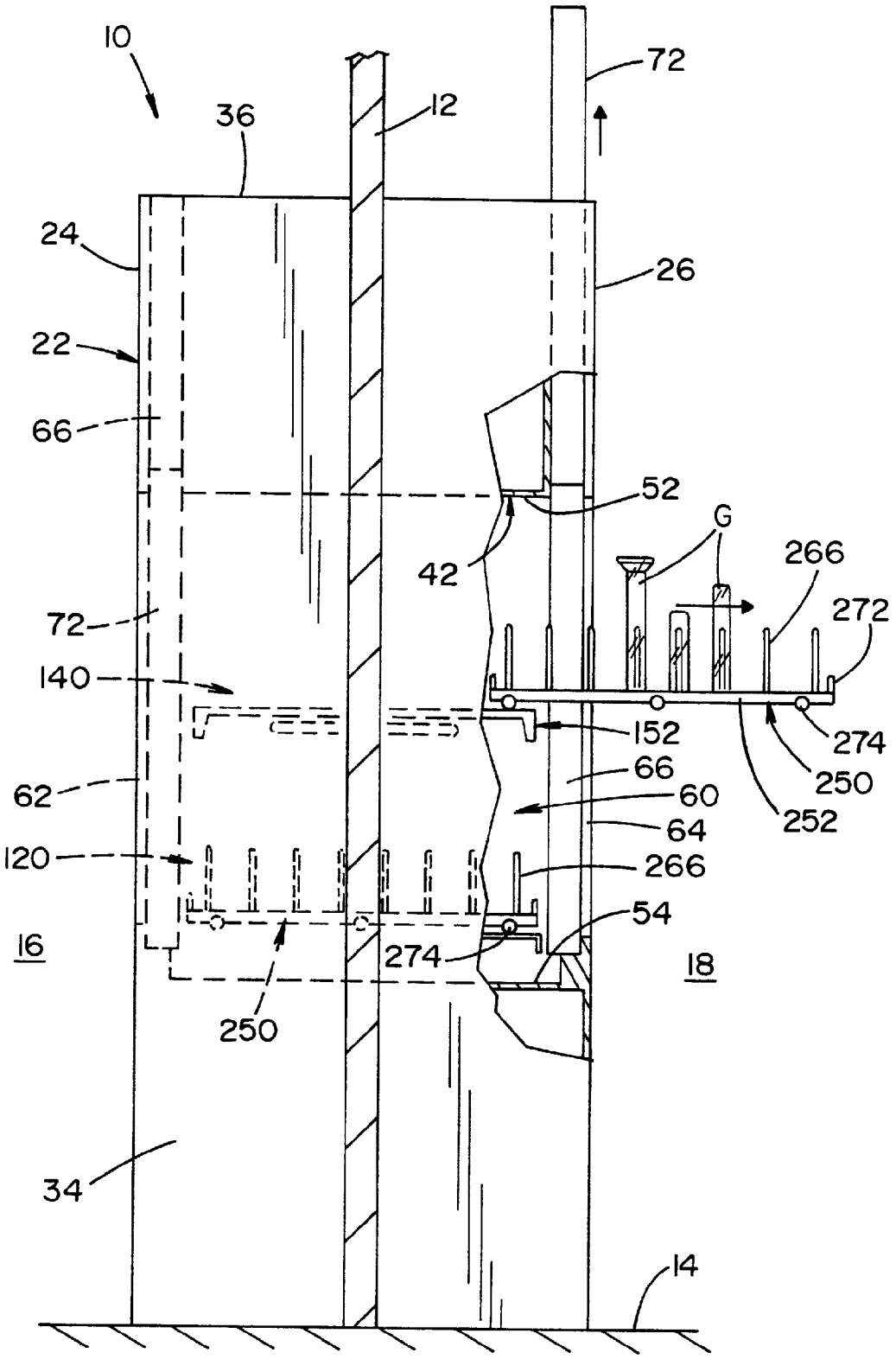
FIG. 2 is a partially-sectioned, elevational view of the decontamination unit (washer) shown in FIG. 1, showing the decontamination unit (washer) positioned within a wall to isolate a front side of the decontamination unit (washer) from a back side of the decontamination unit (washer)

Referring now to the drawings wherein the showings are for the purpose of illustrating a preferred embodiment of the invention only and not for the purpose of limiting same, FIG. 1 shows a decontamination unit (washer) 10, illustrating a preferred embodiment of the present invention. Decontamination unit (washer) 10 is generally comprised of an outer housing 22 that defines the exterior of decontamination unit (washer) 10 and an inner housing 42 that defines a washing chamber 60. Outer housing 22 has a front wall 24, a back wall 26, two side walls 32, 34 and a top wall 36. As illustrated in the drawings, outer housing 22 is generally rectangular in shape.

Inner housing 42 (best seen in FIGS. 3 and 4) is comprised of two spaced-apart side walls 44, 46, a top wall 52 and a bottom wall 54. Walls 44, 46, 52, 54 of inner housing 52 extend from front wall 24 of outer housing 22 to back wall 26 of outer housing 22. Together, outer housing 22 and inner housing 42 define a decontamination unit (washer) chamber 60 having a first opening 62 formed in front wall 24 of outer housing 22 and a second opening 64 formed in back wall 26 of outer housing 22. Vertical slots 66 are formed in outer housing 22 along the sides of openings 62, 64 in front wall 24 and back wall 26 of outer housing 22. Flat, rectangular doors 72, having windows 74 formed integrally therewith, are designed to reciprocally slide vertically in slots 66 between an opened position that allows access to washing chamber 60, and a closed position that closes washing chamber 60 during operation.

In the drawings, decontamination unit (washer) 10 is shown disposed within a wall or partition 12 (shown in phantom lines in FIG. 1) on a floor 14. In such a configuration, first opening 62 in front wall 24 of outer housing 22 would be disposed in a "dirty" room or space 16, and second opening 64 in back wall 26 of outer housing 22 would be disposed in a "clean" room or space 18, as shall be discussed in greater detail below.

Figure 3:
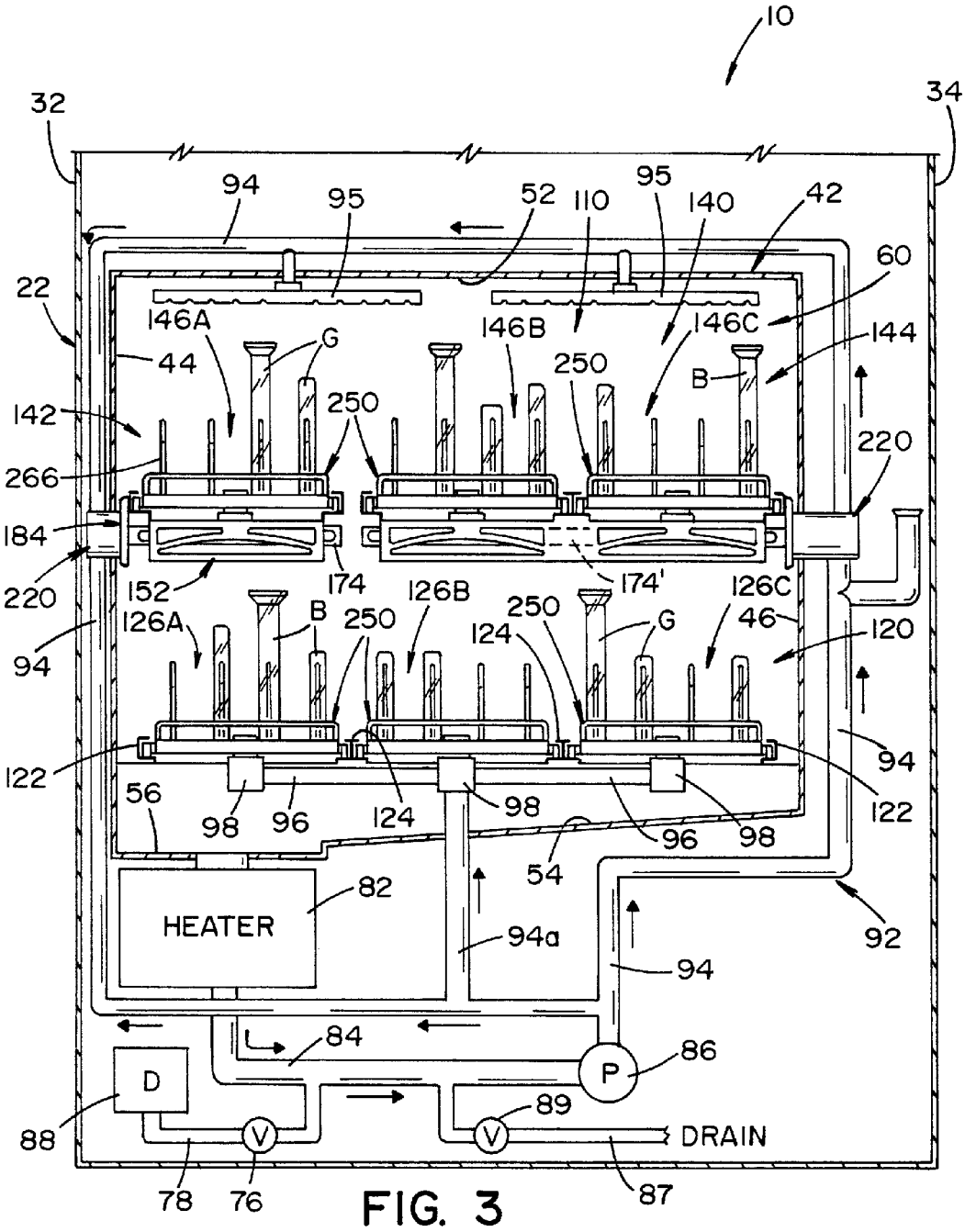
FIG. 3 is a partially-sectioned, front view of the decontamination unit (washer) shown in FIG. 1, showing a shelving system having an upper shelf comprised of a plurality of shelf sections within the washing chamber of the decontamination unit (washer), and schematically showing a fluid circulation system connected to the shelving system.
Figure 4:
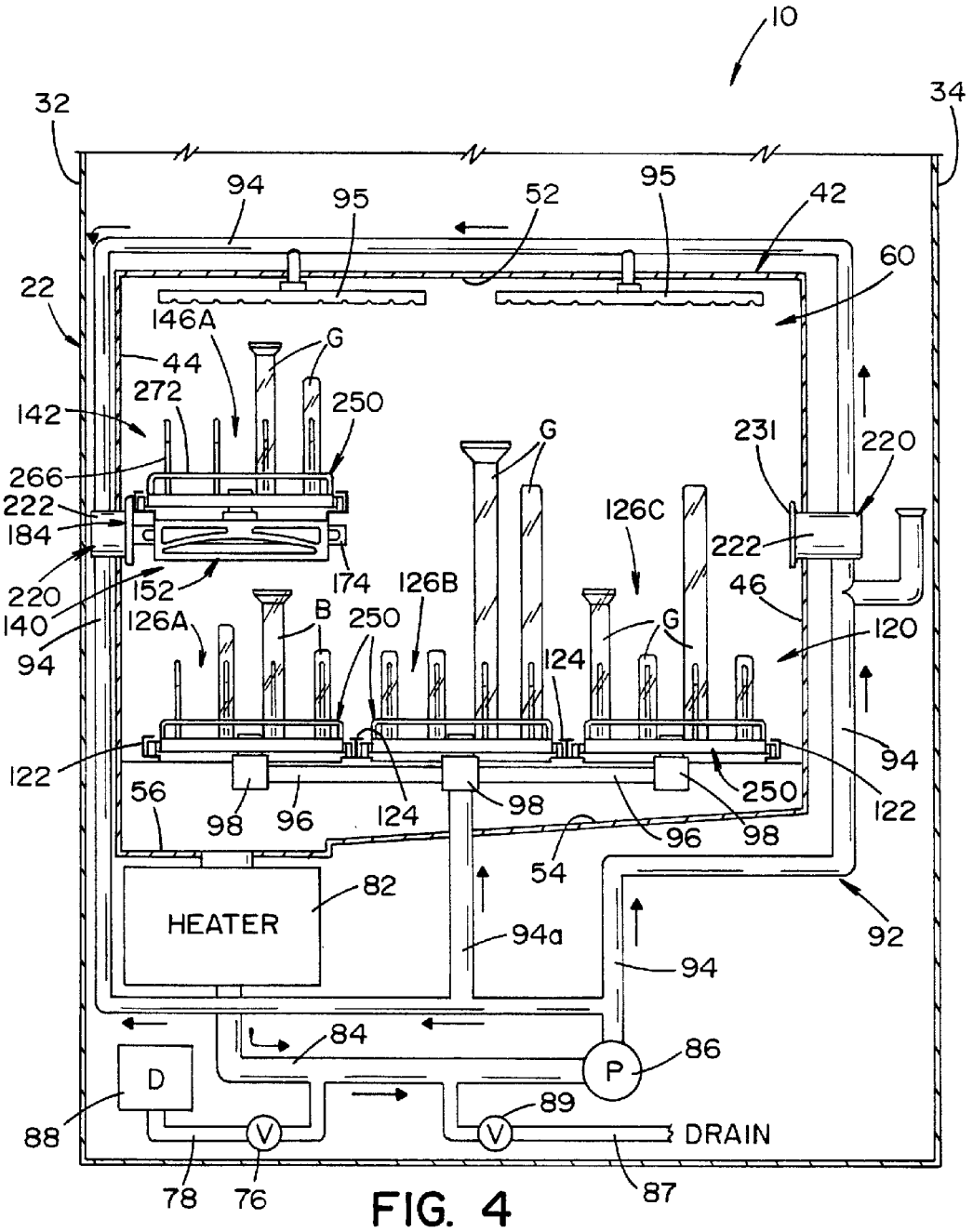
FIG. 4 is a partially-sectioned, front view of the decontamination unit (washer) shown in FIG. 1, showing a shelf section removed from the washing chamber to re-configure the shelving system to accept different sized glassware within the washing chamber.

As best seen in FIGS. 3 and 4, washing chamber 60 is generally rectangular in shape. Bottom wall 54 of inner housing 42 is tapered toward one side to define a sump 56 at the bottommost portion of washing chamber 60. Sump 56 is connected to a heater 82 that is capable of heating fluids flowing therethrough. A fluid line 84 connects the outlet of heater 82 to an inlet of a pump 86. In accordance with the present invention, pump 86 is preferably a two-speed pump. The outlet of pump 86 is connected to a fluid distribution circuit 92. Fluid distribution circuit 92 is basically comprised of a fluid distribution line 94 that forms a closed loop. Fluid distribution line 94 vertically surrounds inner housing 42 and washing chamber 60, but is disposed within outer housing 22. Spray arms 95, disposed within washing chamber 60 beneath top wall 52, are connected to fluid distribution line 94.

A branch line 94*a* from fluid distribution line 94 extends through bottom wall 54 of inner housing 42 into washing chamber 60 and connects to a fluid feeder line having three (3) fluid connectors 98, that shall be described in greater detail below. Fluid distribution line 94 is also in fluid communication with two, spaced-apart mounting/connection assemblies 220 that extend through side walls 44, 46 of inner housing 42 into washing chamber 60. In the embodiment shown, mounting/connection assemblies 220 are generally axially aligned with each other, and are disposed at the same level within washing chamber 60. Mounting/connection assemblies 220 are preferably disposed midway between openings 62, 64 defined in front wall 24 and back wall 26 of outer housing 22. In other words, mounting/connection assemblies 220 are essentially spaced near the middle of side walls 44, 46 of inner housing 42.

A detergent dispenser 88 is connected to fluid line 84 near the inlet of pump 86 to provide detergent to be mixed with heated water flowing through pump 86. A valve 76 in line 78 connecting detergent dispenser 88 to the inlet of the pump controls dispensing of detergent into fluid distribution circuit 92. A controller (not shown) controls the overall operation of decontamination unit (washer) 10 as is conventionally known. A drain line 87 that is connected to fluid line 84 between heater 82 and pump 86 facilitates draining of fluid distribution circuit 92 during different operating cycles, i.e., washing and rinsing of decontamination unit (washer) 10. A valve 89 within drain line 87 controls flow therethrough.

As best seen in FIGS. 1 through 4, decontamination unit (washer) 10 includes a shelving system 110 comprised of a lower shelf assembly 120 and an upper shelf assembly 140 that are disposed horizontally within washing chamber 60. In the embodiment shown, each shelf assembly 120, 140 is designed to hold three (3) removable rack assemblies 250 that, in turn, hold the glassware "G" or articles to be washed.

Lower shelf assembly 120, preferably a rigid, non-removable structure, is basically comprised of transverse horizontal beams (not shown) that are disposed in parallel relationship to each other and that span side walls 44, 46 of washing chamber 60. These transverse beams support two spaced-apart, generally C-shaped rails 122 that are disposed near side walls 44, 46, as best seen in FIGS. 3 and 4. These C-shaped rails 122 define inwardly facing channels and the lower legs of the C-shaped rails 122 define tracks, which shall be described in greater detail below. Disposed between two C-shaped rails 122 are two spaced-apart intermediate rail members 124 that are parallel to C-shaped rails 122. Intermediate rails 124 also define channels and further define tracks for receiving the removable rack assemblies 250, as shall be described in greater detail below. C-shaped rails 122 and intermediate rails 124 effectively divide lower shelf assembly 120 into three, equally sized rack assembly receiving stations, designated 126A, 126B, 126C in the drawings. As illustrated in FIGS. 3 and 4, the three fluid connectors 98 connected to fluid feeder lines 96 are disposed to be centrally located beneath the three rack assembly receiving stations 126A, 126B, 126C defined by rails 122, 124 on lower shelf assembly 120.

In the embodiment shown, upper shelf assembly 140 is comprised of a first shelf section 142 and a second shelf section 144. First shelf section 142 is designed to define a single rack assembly receiving station 146A and to support a single, removable rack assembly 250. Second shelf section 144 is designed to define two rack assembly receiving stations 146B, 146C and to support two removable rack assemblies 250. First shelf section 142 and second shelf section 144 are similar in construction. Therefore, only first shelf section 142 shall be described in detail, it being understood that such description and the basic construction described applies also to second shelf section 144.

Figure 5:
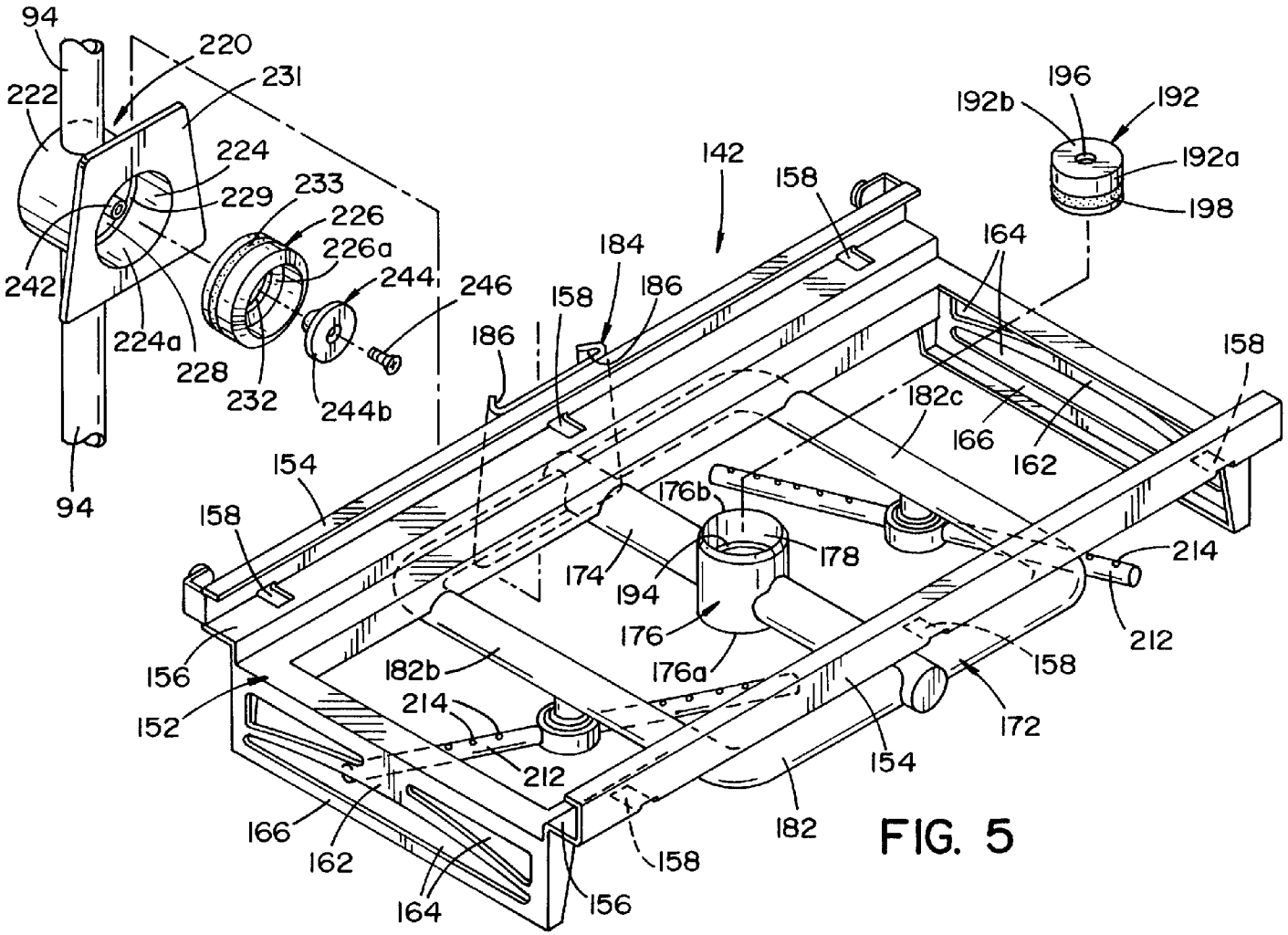
FIG. 5 is a perspective view of a shelf section used within the washing chamber of the decontamination unit (washer), and an exploded view of a mounting/connection assembly for mounting the shelf section within the decontamination unit (washer)
Figure 8:
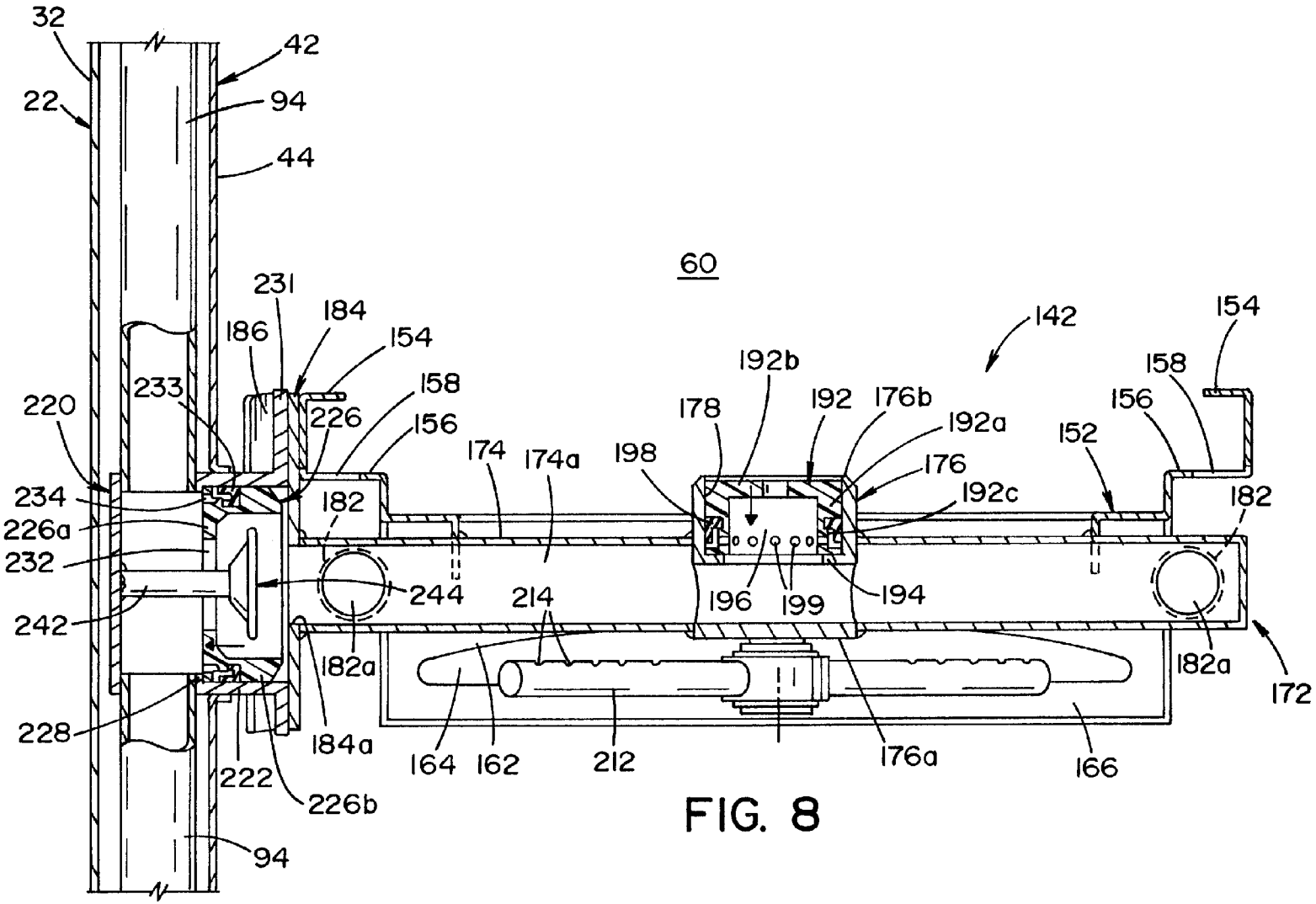
FIG. 8 is a view of the removable shelf section shown in FIG. 7 with the rack assembly removed therefrom.

Referring now to FIG. 5, first shelf section 142 is best seen. As shown in the drawings, first shelf section 142 is generally comprised of a rectangular frame 152 having inward-facing C-shaped sides 154. A lower flange of each C-shaped side 154 defines an elongated roller support surface or track 156. Three, spaced-apart rectangular notches 158 are formed in each roller support surface 156. The longitudinal ends of frame 152 include downward extending panels 162 having elongated apertures 164 formed therein to define a hand grip 166 along the lower edge of each panel 162. Aperture 164 in panels 162 are preferably large to allow fluids sprayed within washing chamber 60 to pass therethrough. Attached to the underside of rectangular frame 152 is a fluid distribution manifold 172. In the embodiment shown, fluid distribution manifold 172 is comprised of cylindrical, tubular piping. Fluid distribution manifold 172 has a tubular, main conduit 174 that traverses the underside of rectangular frame 152. A fluid connection housing 176 is disposed in the center of main conduit 174. Fluid connection housing 176 is generally cylindrical in shape and has a closed bottom end 176*a* and an opened upper end 176*b*, as best illustrated in FIG. 8. Fluid connection housing 176 defines a cylindrical inner cavity 178. The lower half of fluid connection housing 176 is attached to main conduit 174 such that cavity 178 is in fluid communication with an inner passageway 174*a* through main conduit 174. A generally square fluid circuit 182, formed of tubular pipe, intersects the ends of main conduit 174. A passageway 182*a* defined by square fluid circuit 182 communicates with passage 174*a* of main conduit 174. In this respect, passageways 174*a*, 182*a* through main conduit 174 and square fluid circuit 182 are fluidly connected to each other. As shown in the drawings, one end of main conduit 174 is closed and the other end is attached to a mounting sleeve 184. Mounting sleeve 184 has an opening 184*a* formed therethrough to communicate with passageway 174*a* through main conduit 174. Mounting sleeve 184 is generally comprised of a flat plate having the shape of an isosceles trapezoid. The tapered sides of the plate are bent forward, i.e., wrapped around, to define inner slots 186 along the sides of the plate, as best seen in FIG. 5.

Figure 7:
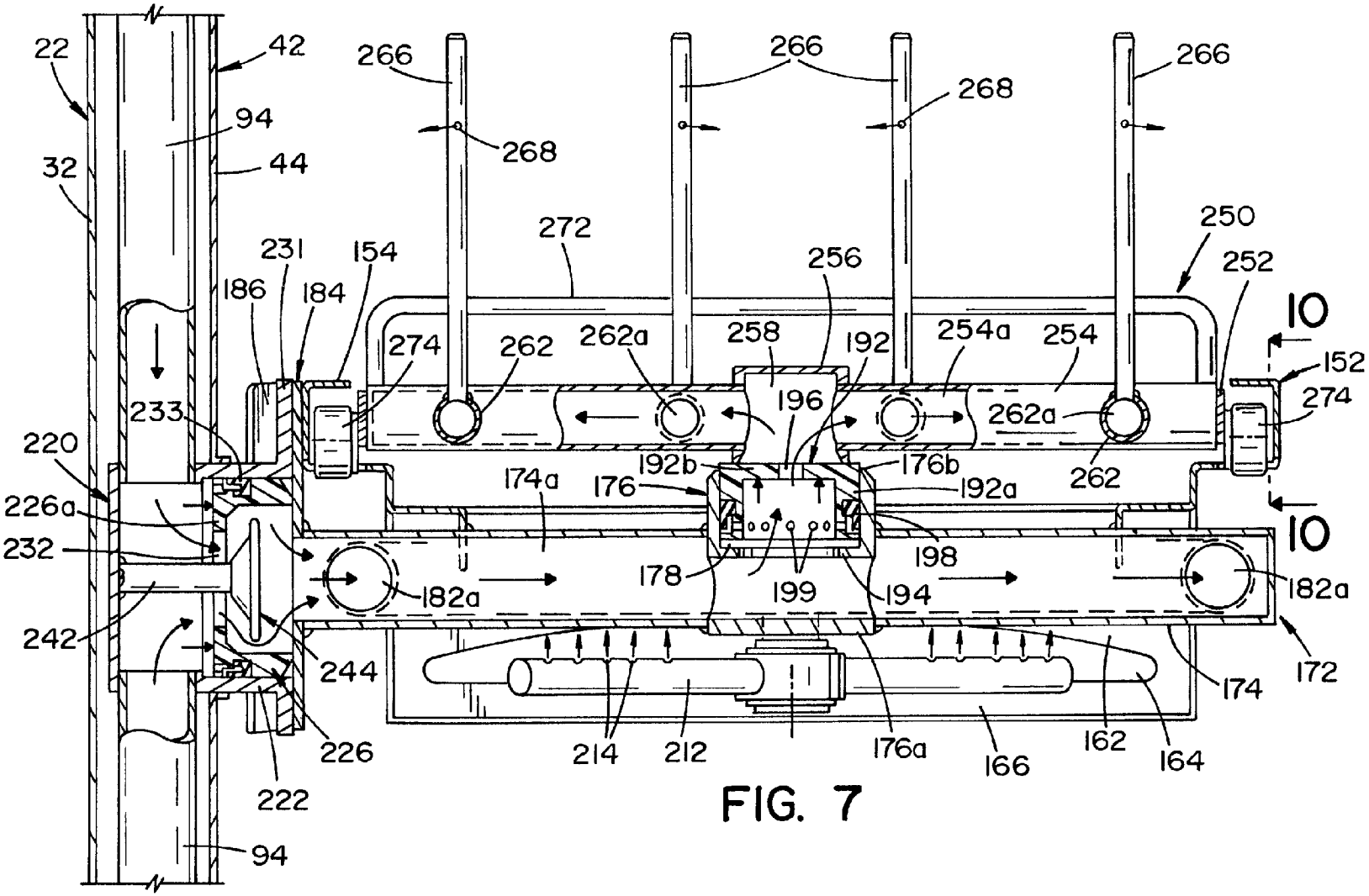
FIG. 7 is an enlarged, cross-sectional view of a removable shelf section mounted within the washing chamber having a rack assembly mounted thereto, showing how fluid flows from a fluid manifold within the decontamination unit (washer) through the shelf section and the rack assembly.

Fluid connection housing 176 is generally disposed within the center of frame 152. Inner cavity 178 of fluid connection housing 176 is dimensioned to receive a piston 192, as best seen in FIGS. 7 and 8. Fluid connection housing 176 includes an inwardly extending annular wall 194 within cylindrical inner cavity 178 which maintains piston 192 in the upper end of inner cavity 178 of fluid connection housing 176. As shown in FIGS. 7 and 8, the lower portion of inner cavity 178 communicates with passage 174*a* through main conduit 174. The upper portion of cylindrical inner cavity 178 receives piston 192 therein. Piston 192 is generally cup-shaped and has a cylindrical side wall 192*a* and a generally flat top wall 192*b*. An aperture 196 extends through top wall 192*b* of piston 192. An annular slot 192*c* is formed in the outer surface of side wall 192*a*. Slot 192*c* is dimensioned to receive an annular gasket 198 therein. Small apertures 199 extend through side wall 192*a* to communicate with slot 192*c* in the side wall and with the underside of gasket 198. As shown in FIGS. 7 and 8, piston 192 is disposed within inner cavity 178 with the opened end of piston 192 facing downward toward the bottom of inner cavity 178 and passage 174*a* of main conduit 174.

Referring now to FIG. 5, square fluid circuit 182 includes leg sections 182*b*, 182*c*. Leg sections 182*b*, 182*c* are generally parallel to main conduit 174. On the undersides of these leg sections 182*b*, 182*c*, rotatable spray arms 212 are mounted. Spray arms 212 include apertures 214 directed upwardly to the underside of frame 152.

Second shelf section 144 is similar to first shelf section 142, as described above, but is essentially twice as wide. Basically, to form second shelf section 144, two first shelf sections 142, are placed side-by-side. A bridging portion connects end panels 162 of the adjacent shelf sections. An elongated main conduit 174' is extended to fluidly connect the fluid distribution manifolds 172 of the side-by-side shelf sections together. As will be appreciated, only one end of the elongated main conduit 174' has a mounting sleeve thereon. The other end of elongated main conduit 174' is closed. Each of the two joined sections has a fluid connection housing 176 and piston 192 connecting to a rack assembly 250. In other words, second shelf section 144 is dimensioned to receive and support two rack assemblies 250.

First shelf section 142 and second shelf section 144 are each dimensioned to be mounted to (and to be removable from) a mounting/connection assembly that is fluidly connected to fluid distribution line 94 and that extends through either side wall 44, 46 of inner housing 42. Mounting/connection assembly 220 that extends through side walls 44 of inner housing 42 is essentially identical to mounting/connection assembly 220 that extends through side wall 46, and therefore, only one shall be described in detail. In this respect, a mounting/connection assembly 220 is basically comprised of an enclosure 222 defining a cavity 224 that is in fluid communication with passageway 94*a* in fluid distribution line 94 that surrounds washing chamber 60. Enclosure 222 has a closed end and an opened end. Cavity 224 has a first portion in fluid communication with passageway 94*a* through fluid distribution line 94 and a second portion at the opened end of enclosure 222. The second portion of cavity 224 has a cylindrical inner surface 224*a* dimensioned to receive a fluid piston 226, as best seen in FIG. 5. An inwardly extending annular wall 228 defines a seat 229 for fluid piston 226. A plate 231 extends outwardly from the free end of enclosure 222. Plate 231 is essentially a flat plate having the shape of an isosceles trapezoid, as best seen in FIG. 5. Plate 231 is oriented such that the parallel sides of the plate are arranged horizontally. Plate 231 is dimensioned to be received within mounting sleeve 184 wherein the side edges of plate 231 are captured in slots 186 of mounting sleeve 184.

Figure 9:
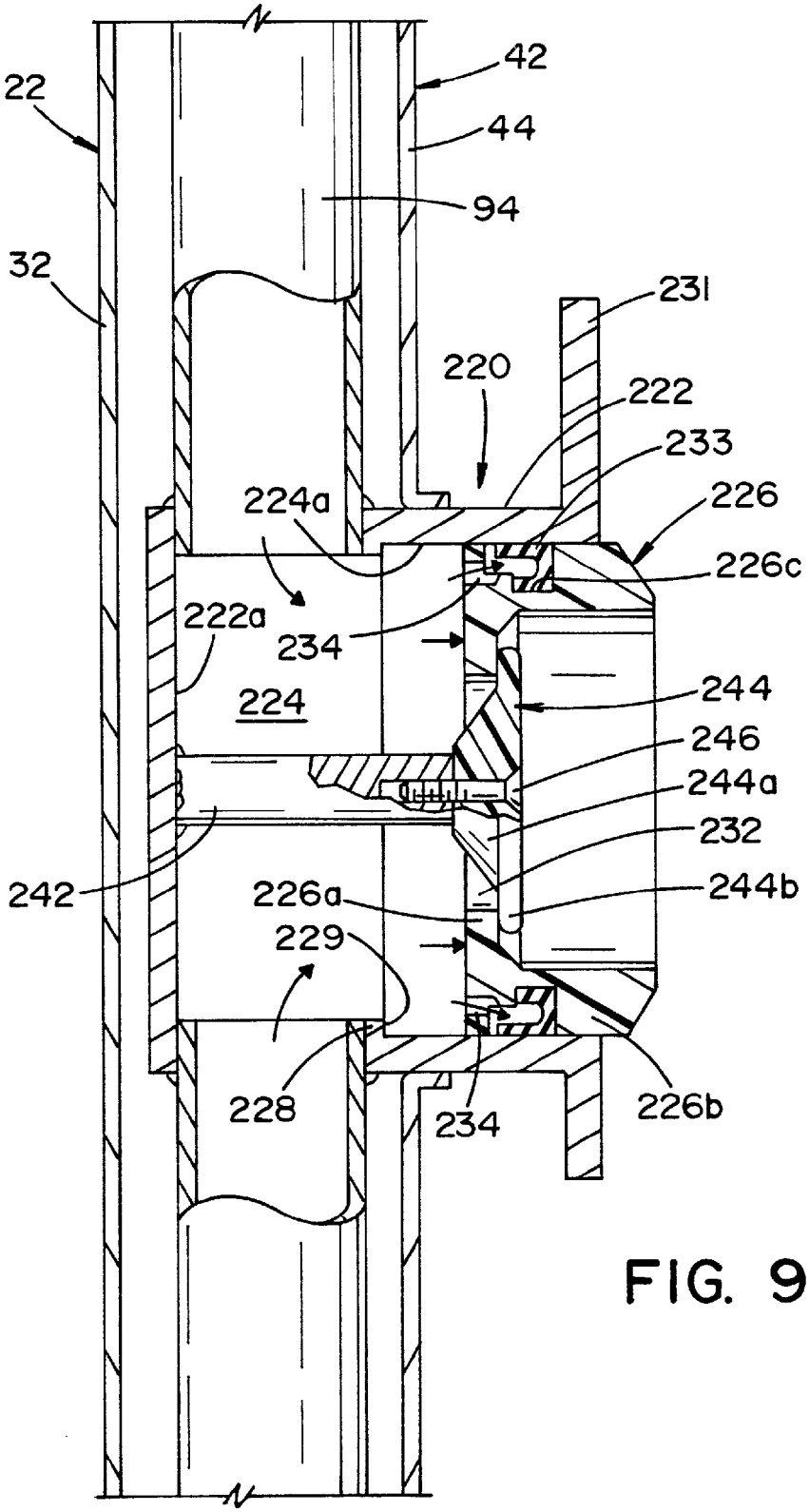
FIG. 9 is an enlarged view of the mounting/connection assembly for mounting a shelf section to the side wall of the washing chamber, showing the position of a valve piston during an operating cycle when a shelf section is not attached to the mounting/connection assembly.

Referring now to FIG. 9, fluid piston 226 is generally cylindrical in shape and has a flat bottom wall 226*a* and a cylindrical side wall 226*b* extending to one side thereof. A fluid opening 232 is formed through bottom wall 226*a* of piston 226, and an annular groove 226*c* is formed in the outer surface of side wall 226*b*. Annular groove 226*c* is dimensioned to receive a J-shaped gasket member 233 therein. Apertures 234 are formed through bottom wall 226*a* to communicate with annular groove 226*c* and the underside of J-shaped gasket member 233.

Figure 6:
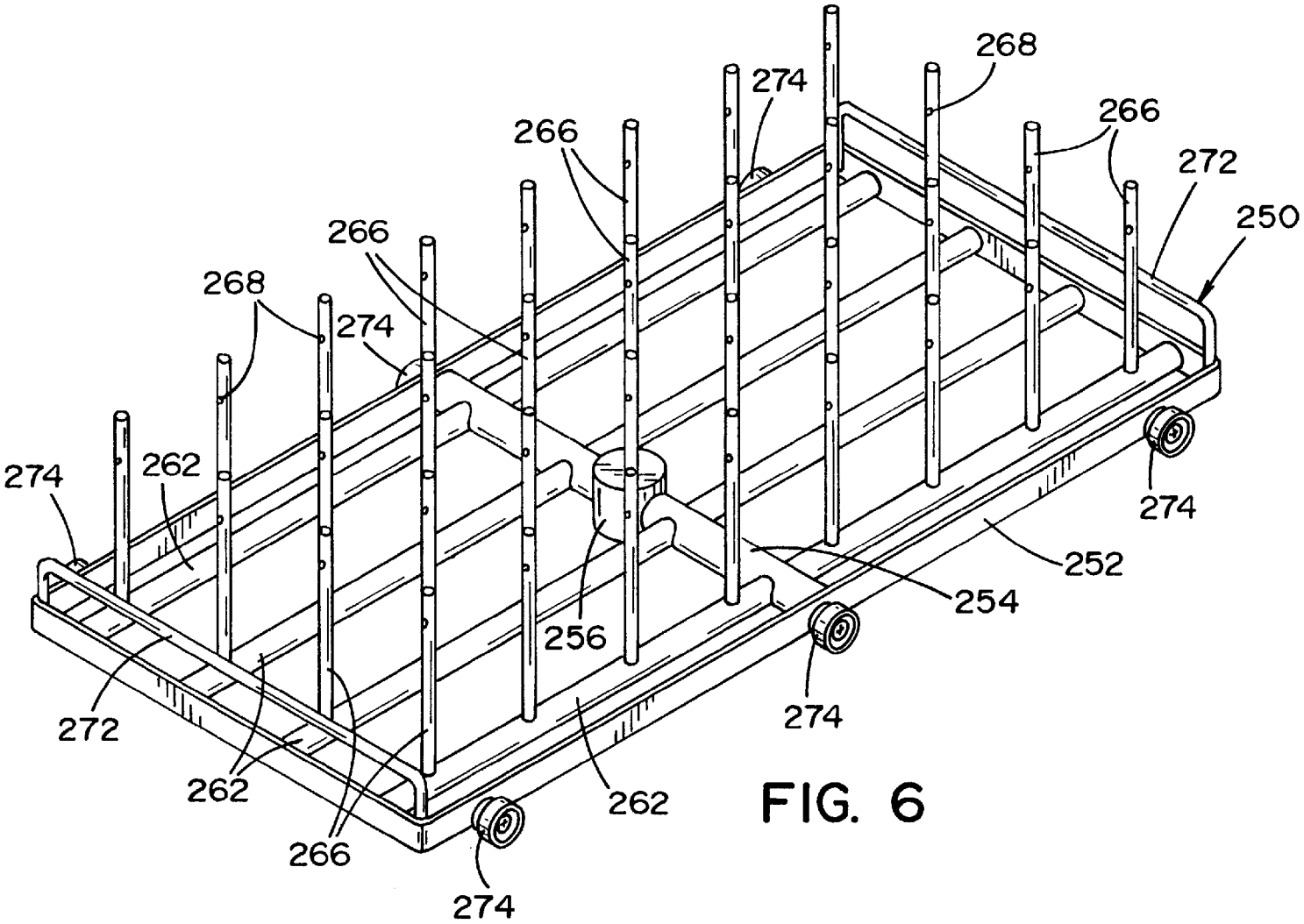
FIG. 6 is a perspective view of a removable rack assembly that is used on the shelves and shelf sections of the decontamination unit (washer) to hold glassware articles to be washed.

A pin or post 242 is attached to bottom wall 222*a* of enclosure 222. Pin 242 extends through cavity 224 of enclosure 222. A resilient polymer stop 244 is attached to the free end of post 242. Stop 244 has a conical body portion 244*a* and a flat, annular flange portion 244*b* extending outwardly therefrom. Flange portion 244*b* is dimensioned to engage the inner surface of bottom wall 226*a* of fluid piston 226 and to limit movement thereof. Stop 244 is attached to the free end of post 242 by a conventional fastener 246 such that piston 226 is captured within cavity 224 of enclosure 222 between seat 229 and stop 244. Stop 244 basically maintains piston 226 within cavity 224 of enclosure 222 and limits movement of piston 226 relative thereto. As best seen in FIGS. 5 and 6, fluid opening 232 through bottom wall 226*a* of piston 226 is larger than the outer dimensions of post 242 so as to allow fluid to flow around stop 244 and through opening 232 defined in bottom wall 226*a* when bottom wall 226*a* of piston 226 is not in contact with annular flange portion 244*b* of stop 244. The free end of side wall 226*b* of piston 226 is tapered to form a conical-shaped end, as best seen in FIG. 9. By way of example, not limitation, piston 226 may be formed of Teflon or stainless steel.

Referring now to FIG. 6, removable rack assembly 250 is best seen. Rack assembly 250 is essentially comprised of an elongated metal strip that is formed into a rectangular frame 252. A manifold pipe 254 traverses frame 252 and is secured to the sides of frame 252. Manifold pipe 254 is closed at both ends, but defines a central passageway 254*a* therethrough. A central hub 256 is disposed in manifold pipe 254 at the mid-section thereof. Central hub 256 is basically a cylindrical cup-shaped element having a closed upper end and an opened lower end having a flat edge. Hub 256 defines a cylindrical cavity 258 on the underside thereof. Cavity 258 is in fluid communication with passageway 254*a* extending through manifold pipe 254. Fluid distribution conduits 262 extend from manifold pipe 254 to the longitudinal ends of rectangular frame 252. In the embodiment shown, distribution conduits 262 are cylindrical pipes having one end attached to manifold pipe 254 and the other end attached to the longitudinal ends of rectangular frame 252. Distribution conduits 262 define fluid pathways 262*a* from passageway 254*a* in manifold pipe 254 to a plurality of spindles 266 that extend vertically upward from distribution conduits 262. As best seen in FIGS. 6 and 7, pluralities of spaced-apart spindles 266 extend generally perpendicular to the plane of frame 252. Spindles 266 are essentially hollow tubes that are in fluid communication with pathways 262*a* through distribution conduits 262. Apertures 268 are formed in spindles 266 and are dimensioned to allow fluid flowing through manifold pipe 254, fluid distribution conduits 262 and spindles 266 to generate directional sprays of fluid.

A generally U-shaped handle 272 is attached to each end of frame 252. Three, spaced-apart rollers 274 are attached to each side of rectangular frame 252. Rollers 274 are positioned on frame 252 to allow rack assemblies 250 to roll upon a flat surface. In this respect, rack assemblies 250 are dimensioned such that rollers 274 may roll upon the roller support surface 156 defined by C-shaped sides 154 of shelf sections 142, 144, as best illustrated in FIG. 7. Rollers 274 mounted to frame 252 of rack assemblies 250 are spaced-apart such that they interact with notches 158 of roller support surfaces 156. In this respect, notches 158 are located relative to fluid connection housings 176 on shelf sections 142, 144 such that when rollers 274 on a rack assembly 250 are disposed within notches 158, as illustrated in FIG. 7. A central hub 256 on a rack assembly 250 is in registry with a fluid connection housing 176 on shelf sections 142 or 144, and the lower flat edge of hub 256 is above top wall 192*b* of piston 192, as illustrated in FIG. 7. The components heretofore described, namely, shelving system 110, rack assemblies 250 and mounting/connection assembly 220 are preferably formed of a non-corrosive metal, such as, by way of example and not limitation, stainless steel.

Referring now to the operation of decontamination unit (washer) 10, first and second shelf sections 142, 144 are designed to be mounted to mounting/connection assemblies 220 on the side walls 44, 46 of inner housing 42 that defines washing chamber 60. In accordance with one aspect of the present invention, since mounting sleeve 184 on the sides of first shelf section 142 and second shelf section 144 are identical, and mounting plate 231 on mounting/connection assemblies 220 are identical, first shelf section 142 and second shelf section 144 can be mounted to either side of washing chamber 60.

When mounted to mounting/connection assembly 220, shelf sections 142, 144 assume a position best illustrated in FIG. 8. FIG. 8 shows first shelf section 142 mounted onto side wall 44 of inner housing 42. In this position, turned ends of mounting sleeve 184 on first shelf section 142 rests upon the sloping sides of mounting plate 231 of mounting/connection assembly 220. In similar respects, second shelf section 144 would be attached, if desired, to mounting/connection assembly 220 on the opposite side wall 46 of inner housing 42. With both first and second shelf sections 142, 144 attached to inner housing 42, lower and upper shelf assemblies 120, 140 would assume a configuration as illustrated in FIGS. 1 and 3. (FIG. 4 illustrates a configuration where only first shelf section 142 is attached to mounting/connection assembly 220 on side wall 44 of inner housing 42). As noted above, removable rack assemblies 250 are dimensioned to be received on a shelf assembly 120, 140. Lower shelf assembly 120 is dimensioned to receive three (3) removable rack assemblies 250. First shelf section 142 of upper shelf assembly 140 is dimensioned to receive one rack assembly 250, and second shelf section 144 of upper shelf assembly 140 is dimensioned to receive two rack assemblies 250.

Rollers on rack assemblies 250 allow rack assemblies 250 to be rolled into position relative to lower shelf assembly 120 and first and second shelf sections 142, 144 of upper shelf assembly 140. In this respect, as indicated above, rectangular notches 158 on roller support surfaces 156 of rectangular frame 152 of shelf sections 142, 144 are positioning means wherein rollers 274 on rack assemblies 250 fall into rectangular notches 158 and locate rack assemblies 250 in a predetermined position relative to a shelf section 142 or 144. Specifically, rack assemblies 250 are positioned on the lower shelf assembly 120 and a first and second shelf section 142, 144 such that a central hub 256 on a rack assembly 250 is positioned immediately above a fluid connection housing 176 on the lower shelf assembly 120 or on the first or second shelf sections 142, 144. As illustrated in FIG. 4, if second shelf section 144 is not inserted into washing chamber 60, taller glassware "G" may be inserted into decontamination unit (washer) 10 and washed together with smaller glass articles in washing chamber 60. In this respect, FIG. 6 shows a rack assembly 250 with uniformly spaced spindles 266 of the same height. As will be appreciated, special rack assemblies (not shown) may be produced to have longer spindles 266 to accommodate taller or longer glass articles or the number of spindles 266 may be reduced and the spacing between spindles 266 increased for wider glassware "G," such as flasks or beakers. Because a rack assembly 250 is easily removable from lower shelf assembly 120 and/or shelf sections 142, 144, a rack assembly 250, designed for specific types of glassware "G," may be used during a single washing cycle.

During a washing or rinsing cycle, washing or rinsing fluid is conveyed through fluid distribution circuit 92 by pump 86. In this respect, fluid is conveyed through fluid distribution line 94, wherein the fluid is forced into enclosure 222 of each mounting/connection assembly 220. Fluid forced into cavity 224 of enclosure 222 is forced against the underside of bottom wall 226*a* of fluid piston 226. In this respect, the force of the fluid exerted on the underside of bottom wall 226*a* forces fluid piston 226 against the flat portion of mounting sleeve 184 on first shelf section 142. As shown in FIG. 7, fluid piston 226 and mounting/connection assembly 220 are dimensioned such that when fluid piston 226 abuts mounting sleeve 184, fluid is allowed to flow through opening 232 in bottom wall 226*a* of fluid piston 226, around stop 244 and into main conduit 174 of first shelf section 142. Fluid is also forced through apertures 234 in bottom wall 226*a* of piston 226 to the back side of J-shaped gasket 233. As a result, J-shaped gasket 233 expands against the inner cylindrical surface of mounting/connection assembly 220 to form a seal therewith.

As a result, a quick connection and seal are formed between mounting/connection assembly 220 and first shelf section 142. As a result of this connection, fluid is forced around the stop 244 and fills the main conduit 174 of fluid distribution manifold 172 on shelf section 142. As main conduit 174 is filled, fluid eventually comes in contact with top wall 192*b* of piston 192 in fluid connection housing 176. Because opening 196 through top wall 192*b* of piston 192 has a smaller cross-section than the passageway of main conduit 174, a pressure build-up will occur against top wall 192*b* of piston 192. The pressure on top wall 192*b* of piston 192 forces piston 192 in an upward direction against central hub 256 on rack assembly 250. The weight of rack assembly 250 and the glassware "G" thereon maintains the lower, flat edge of central hub 256 against the upper surface of piston 192 thereby creating a seal between central hub 256 and piston 192. Fluid flowing through aperture 199 in side wall 192*a* of piston 192 is forced into slot 192*c* and against the back side of gasket 198. Gasket 198 is forced against the inner surface of fluid connection housing 176, thereby forming a fluid seal between fluid connection housing 176 and piston 192.

With seals formed between mounting/connection assembly 220 and shelf section 142, and between shelf section 142 and rack assembly 250, fluid from fluid distribution circuit 92 is forced into main pipe 254 of rack assembly 250 and into distribution conduits 262, where it is forced up into spindles 266. The fluid is then forced through apertures 268 in spindles 266 to convey either washing fluid or rinsing fluid to the interior portions of the glassware "G" mounted on spindles 266. At the same time, fluid is forced to rotary spray arms 212 on the underside of first shelf section 142, that, in turn, sprays fluid (either washing fluid or rinsing fluid) against the underside of rack assembly 250 and the glassware "G" thereon.

Because of the piston-type connections between shelf sections 142, 144 and sides 44, 46 of washing chamber 60, and between shelf sections 142, 144 and rack assemblies 250, fluid loss through these types of connections is minimal, as compared to prior assemblies. Reducing fluid loss through the fluid circuits to spindles 266 enables pump 86 within decontamination unit (washer) 10 to operate at a lower speed while maintaining better washing pressure at apertures 268 of spindles 266.

When a washing cycle or rinsing cycle is completed, fluid is more easily drained from the disclosed structure because of the use of circular tubing and piping which retains less water and residual material within the piping system during a draining operation.

In the event that first shelf section 142 and/or second shelf section 144 are not inserted during an operating cycle, mounting/connection assembly 220 prevents fluid in fluid distribution line 94 from flowing into washing chamber 60.

As illustrated in FIG. 9, in absence of a shelf section 142, 144 being mounted onto mounting plate 231 of mounting/connection assembly 220, piston 226 moves toward the center of washing chamber 60. In this respect, fluid pressure acting on the underside of bottom wall 226*a* of piston 226 forces piston 226 against annular flange portion 244*b* on stop 244. As shown in FIG. 9, flange portion 244*b* operatively engages the inner surface of bottom wall 226*a* to effect a seal between stop 244 and bottom wall 226*a* of piston 226 thereby preventing fluid from being forced out from the fluid distribution line 94. Fluid is still forced through apertures 234 in bottom wall 226*a* to the back side of gasket 233 to inflate gasket 233 against enclosure 222 of mounting/connection assembly 220, to further facilitate a seal between piston 226 and enclosure 222. Thus, when first shelf section 142 or second shelf section 144 of upper shelf assembly 140 is not inserted or mounted to washing chamber 60, mounting/connection assembly 220 automatically seals itself to prevent fluid in fluid distribution line 94 from entering washing chamber 60 through mounting/connection assembly 220.

Heretofore, the fluid connections between first shelf section 142 and second shelf section 144 and mounting/connection assembly 220 in washing chamber 60 have been discussed. In similar fashion, lower shelf assembly 120 includes a number of fluid connection housings 176 that are dimensioned to mate with hubs 256 on rack assemblies 250, as heretofore described. In other words, when rack assemblies 250 are inserted in rack positions on lower shelf assembly 120, pistons 192 in fluid connection housing 176 interact with hubs 256 on rack assemblies 250 to form a seal therebetween, as heretofore described. As will be appreciated from an understanding of the specification and the drawings, rack assemblies 250 need to be in position on each of the shelf locations or shelf sections 142, 144 to form a connection between shelf locations and shelf sections 142, 144 and rack assemblies 250 to prevent fluid from being forced from lower shelf assembly 120 or first and second shelf sections 142, 144 during operation of decontamination unit (washer) 10.

It will be appreciated that because mounting/connection assembly 220 that connects the fluid distribution circuit 92 to first and second shelf sections 142, 144 are located on side walls 44, 46 of inner housing 42 that forms washing chamber 60, front and back openings 62, 64 may be provided in front and back walls 24, 26 of washing chamber 60. As a result, decontamination unit (washer) 10 can be utilized as part of a "dirty room" and a "clean room" facility wherein wall 12 divides a dirty room from a clean room, and wherein rack assemblies 250 containing dirty glassware "G" can be rolled into washing chamber 60 from dirty room 16 and, after a washing cycle, be removed through opening 64 in back wall 26 of decontamination unit (washer) 10 into clean room 18. By arranging fluid distribution circuit 92 of decontamination unit (washer) 10 such that fluid distribution line 94 surrounds the top, sides and bottom of washing chamber 60, openings 62, 64 in front and back walls 24, 26 of washing chamber 60 allow access into and out of washing chamber 60 from two directions.

The present invention thus provides a decontamination unit (washer) 10 and universal shelving system that allows greater access to and from washing chamber 60, and at the same time allows each shelf section that comprises the upper shelf assembly 140 to be mounted in washing chamber 60 on either side of washing chamber 60. Still further, the sealing arrangement between the fluid circulation system and the shelf sections and between shelf sections 142, 144 or shelf assembly 120 and rack assemblies 250 facilitates more accurate fluid sealing of the fluid circulation system thereby allowing pumps 86 to operate more efficiently and at lower speeds, yet provide greater washing pressure to articles (glassware) to be cleaned.

Figure 10:
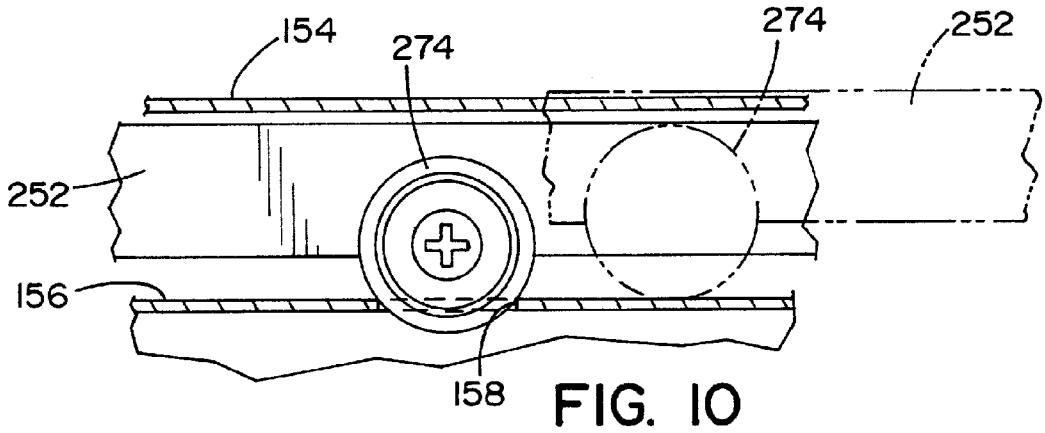
FIG. 10 is a sectional view taken along lines 10-10 of FIG. 7, showing a wheel on a rack assembly positioned within a rectangular notch formed in a track of a shelf section for locating the rack assembly on the shelf section during an operating cycle.
Figure 11:
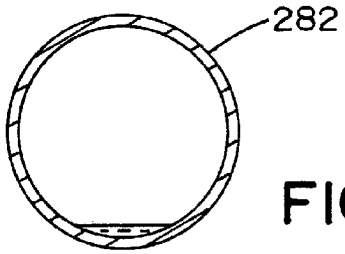
FIG. 11 is a sectional view through a fluid conduit having a circular cross-section illustrating the amount of residual fluid that may remain within the fluid conduit following an operating cycle.
Figure 12:
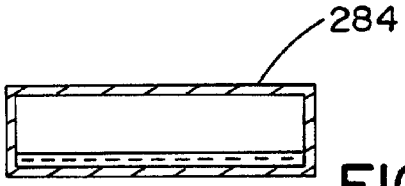
FIG. 12 (PRIOR ART)
FIG. 12 is a cross-sectional view of a fluid conduit having a rectangular cross-section illustrating the amount of fluid that may remain within such a fluid conduit following an operating cycle.

Still further, FIGS. 10 and 11 schematically illustrate how use of conduits and pipes 282 having a circular cross-section retain less fluid between cycles as compared to pipes or conduits 284 having a rectangular cross-section.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A washer, comprising:

a washing chamber defined by a pair of side walls, a top wall and a bottom wall, said washing chamber having an openable front face and an openable back face;

a fluid circulation system for circulating a fluid through said washing chamber;

a first shelf assembly mounted within the washing chamber having at least one first shelf section for receiving and supporting articles to be cleaned during a washing operation;

a second shelf assembly mounted within the washing chamber vertically above the first shelf assembly, the second shelf assembly being mountable to the side walls and having at least two second shelf sections, at least one of the at least two second shelf sections being selectively removable from the washing chamber so that additional space may be provided for larger articles on one side of the first shelf, so that articles may be inserted into or removed from said washing chamber through said front face or back face of said washing chamber; and a mounting/connection assembly extending through one of said side walls for mounting said at least one of the at least two second shelf sections only to said one of said side walls and for fluidly connecting said at least one of the at least two second shelf sections to said fluid circulation system through said one of said side walls, wherein said front face and said back face define unobstructed openings for inserting and removing said articles into and from said washing chamber.

2. A washer as defined in claim 1, wherein said fluid circulation system is disposed outside said washing chamber.

3. A washer as defined in claim 1, wherein said at least one of the at least two second shelf sections includes a fluid distribution manifold for distributing fluid to different parts of said at least one of the at least two second shelf sections, said fluid distribution manifold being in fluid communication with said fluid circulation system through said mounting/connection assembly when said at least one of the at least two second shelf sections is mounted to said one of said side walls of said washing chamber.

4. A washer as defined in claim 1, wherein said mounting/connection assembly is mounted to said one of said side walls of said washer and includes a movable piston, said piston movable into engagement with said at least one of the at least two second shelf sections when said at least one of the at least two second shelf sections is mounted to said mounting/connection assembly and when a pressurized fluid is flowing through said fluid circulation system, wherein said piston forms a sealed connection between said fluid circulation system and said at least one of the at least two second shelf sections.

5. A washer as defined in claim 4, wherein said mounting/connection assembly includes a stop, said piston movable into engagement with said stop when said at least one of the at least two second shelf sections is removed from said washing chamber and when a pressurized fluid is flowing through said fluid circulation system, wherein said piston forms a seal against said stop to prevent fluid flowing through said fluid circulation system from entering said washing chamber through said mounting/connection assembly.

6. A washer as defined in claim 1, wherein both of said at least two second shelf sections are selectively removable from said washing chamber.

7. A washer as defined in claim 1, wherein each of said at least two second shelf sections is mountable to each of said side walls defining said washing chamber.

8. A washer as defined in claim 1, further comprising a removable rack assembly that is mountable to each of said at least two second shelf sections, said rack assembly being reciprocally slidable relative to each of said at least two second shelf sections and being slidable into and out of said washing chamber through said front face and said back face.

9. A washer as defined in claim 8, wherein each of said at least two second shelf sections includes tracks for guiding a rack assembly thereon, said rack assembly including rollers movable through said tracks on each of said at least two second shelf sections.

10. A washer as defined in claim 1, wherein said at least two second shelf sections are fluidly connected to said fluid circulation system through respective ones of said side walls, said fluid circulation system being disposed outside said washing chamber and being operable to circulate fluid through said washing chamber and to said at least two second shelf sections.

11. A washer as defined in claim 10, wherein each of said at least two second shelf sections includes a fluid distribution manifold connectable to said fluid circulation system when said at least two second shelf sections are mounted to said respective ones of said side walls.

12. A washer as defined in claim 11, wherein said fluid circulation system is connected to sprayers in said washing chamber and said fluid distribution manifold of said at least one of the at least two second shelf sections is connected to a sprayer on said at least one of the at least two second shelf sections.

13. A washer as defined in claim 1, wherein said mounting/connection assembly is comprised of a plate attached to said one of said side walls of said washing chamber; and said at least one of the at least two second shelf sections includes a sleeve attached to a side of said at least one of the at least two second shelf sections, said sleeve being mountable onto said plate.

14. A washer as defined in claim 13, wherein said plate has an isosceles-trapezoid shape and said sleeve has a mating shape to receive said plate.

15. A washer, comprising:

a washing chamber defined by a pair of side walls, a top wall and a bottom wall, said washing chamber having an openable front face and an openable back face;

a fluid circulation system for circulating a fluid through the washing chamber;

a first shelf assembly mounted within the washing chamber having at least one first shelf section for receiving and supporting articles to be cleaned during a washing operation;

a second shelf assembly mounted within the washing chamber vertically above the first shelf assembly, the second shelf assembly having at least two second shelf sections, at least one of the at least two second shelf sections being selectively removable from the washing chamber so that additional space may be provided for larger articles on one side of the first shelf, so that articles may be inserted into or removed from the washing chamber through the front face or the back face of the washing chamber, the at least one of the at least two second shelf sections having a side disposed adjacent one of the pair of side walls when the at least one of the at least two second shelf sections mounted within the washing chamber; and a mounting/connection assembly extending through one of said side walls for mounting the at least one of the at least two second shelf sections within the washing chamber and for fluidly connecting the at least one of the at least two second shelf sections to the fluid circulation system through said one of said side walls, wherein only the side of the at least one of the at least two second shelf sections disposed adjacent said one of the pair of side walls is mounted to the mounting/connection assembly and wherein the mounting/connection assembly does not obstruct the front face or the back face of the washing chamber.

16. A washer as defined in claim 15, wherein the fluid circulation system is disposed outside the washing chamber.

17. A washer as defined in claim 1, further comprising:

a first door moveable relative to said front face of said washing chamber between an opened position that allows access to said washing chamber through said front face and a closed position that closes said front face of said washing chamber; and a second door moveable relative to said back face of said washing chamber between an opened position that allows access to said washing chamber through said back face and a closed position that closes said back face of said washing chamber.

18. A washer as defined in claim 15, further comprising:

a first door moveable relative to said front face of said washing chamber between an opened position that allows access to said washing chamber through said front face and a closed position that closes said front face of said washing chamber; and a second door moveable relative to said back face of said washing chamber between an opened position that allows access to said washing chamber through said back face and a closed position that closes said back face of said washing chamber.

19. A washer for cleaning articles during a washing operation, said washer comprising:

a washing chamber defined by a pair of side walls, a top wall, and a bottom wall, said washing chamber having an openable front face and an openable back face, each of the faces being configured to allow insertion of said articles into said washing chamber and removal of said articles from said washing chamber;

a fluid circulation system configured to circulate fluid through said washing chamber;

a first shelf assembly mounted within the washing chamber, the first shelf assembly comprising at least one first shelf section configured to receive and support said articles;

a second shelf assembly positioned vertically above the first shelf assembly and mounted to the side walls, the second shelf assembly comprising at least two second shelf sections respectively configured to receive and support said articles; and a mounting/connection assembly extending through one of said side walls, the mounting/connection assembly being configured to secure at least one of the two second shelf sections to said one of said side walls and fluidly connect the at least one of the two second shelf sections to the fluid circulation system through said one of said side walls, wherein the second shelf assembly is configured to allow selective removal of other ones of the at least two second shelf sections from the washing chamber through the front face or the back face to enable the at least one first shelf section to support one of the articles having a height that is greater than a height of the other ones of the at least two second shelf sections above the at least one first shelf section.

* * * * *